US005624300A

United States Patent [19]

Kishii et al.

[11] Patent Number: 5,624,300

[45] Date of Patent: Apr. 29, 1997

[54] APPARATUS AND METHOD FOR UNIFORMLY POLISHING A WAFER

[75] Inventors: Sadahiro Kishii; Yoshihiro Arimoto, both of Kawasaki, Japan

[73] Assignee: Fujitsu Limited, Kawasaki, Japan

[21] Appl. No.: 676,663

[22] Filed: Jul. 10, 1996

Related U.S. Application Data

[62] Division of Ser. No. 131,949, Oct. 8, 1993, Pat. No. 5,562,529.

[30] Foreign Application Priority Data

Oct. 8, 1992 [JP] Japan ..... 4-270438
Oct. 8, 1992 [JP] Japan ..... 4-270440

[51] Int. Cl.[6] ..... B24B 1/00; B24B 7/16

[52] U.S. Cl. ..... 451/36; 451/54; 451/63; 451/285

[58] Field of Search ..... 451/36, 41, 54, 451/63, 259, 908, 28, 287, 285, 288, 290, 495, 504, 913

[56] References Cited

U.S. PATENT DOCUMENTS 4,211,041 7/1980 Sakullevich et al. ..... 451/287
4,270,316 6/1981 Kramer ..... 451/288

FOREIGN PATENT DOCUMENTS 62-208868 9/1987 Japan ..... 451/287
1614906 12/1990 U.S.S.R. ..... 451/28

*Primary Examiner*—James G. Smith
*Assistant Examiner*—Derris H. Banks
*Attorney, Agent, or Firm*—Staas & Halsey

[57] ABSTRACT

For providing a method for polishing in which it is possible to polish a substance uniformly over a whole surface of a wafer without observing the polished surface of the wafer halfway through polishing, a wafer with current detective patterns formed of conductors directly contacted with a semiconductor substrate, and an insulating film covering the current detective patterns is held by a wafer holder with conductivity, and the insulating film is polished by a polisher in which a supporting plate with conductivity is exposed in openings through a polishing cloth while supplying a polishing slurry containing ions.

8 Claims, 16 Drawing Sheets

APPARATUS AND METHOD FOR UNIFORMLY POLISHING A WAFER

This application is a division of application Ser. No. 08/131,949, filed Oct. 8, 1993, now U.S. Pat. No. 5,562,529.

BACKGROUND OF THE INVENTION

1. Field of the Invention

The present invention relates to an apparatus polishing and a method for polishing, and particularly to an apparatus and a method for uniformly polishing a wafer to planarize a surface of the wafer having interconnection layers and an insulating film covering the interconnection layers.

2. Description of the Related Art

An apparatus for polishing according to the related art will be described with reference to FIG. 1(*a*) and FIG. 1(*b*). It is introduced in the document of J. Electrochem. Soc., Vol.138, No.11, November 1991 by F. B. Kaufman et al.

In FIG. 1(*a*) and FIG. 1(*b*), reference numeral 1 indicates a polisher having a disk-like supporting board 2 which is capable of turning on a shaft 1*a*, and a polishing cloth 3 stuck on the supporting board 2. Reference numeral 4 indicates a disk-like wafer holder for holding and fixing on a wafer holding surface a wafer 6 having an interconnection layer and an insulating film covering the interconnection layer. A wafer holding surface is on the side opposed to the polishing cloth 3. The diameter of the wafer holder 4 is smaller than that of the polisher 1. The wafer holder 4 is turned on a shaft 4*a* in the same direction as the turning direction of the polisher 1. Reference numeral 5 indicates a nozzle for supplying a polishing slurry 13 containing colloidal silica.

Next, a method for polishing using the above apparatus for polishing will be described with reference to FIG. 2(A) to FIG. 2(*c*).

FIG. 2(*a*) is a sectional view of a wafer showing the state after an interlayer insulating film covering the interconnection layer is formed and before the interlayer insulating film is polished. In this figure, reference numeral 7 indicates a semiconductor substrate; 8 is a backing insulating film; 9 is a lower interconnection layer formed on the backing insulating film 8; 10*a* and 10*b* are cylindrical conductive layers for connecting the lower interconnection layer 9 to upper interconnection layers formed later, which are formed at two points on the lower interconnection layer 9; and 11 is an interlayer insulating film covering the lower interconnection layer 9 and the conductive layers 10*a* and 10*b*.

In such a state, first, the wafer 6 is held and fixed on the wafer holder 4 as shown in FIG. 1(*a*). Subsequently, the surface of the wafer 6 is in parallel to the surface of the polishing cloth 3. Then, the wafer holder 4 and the polisher 1 are turned in the same direction, and the wafer holder 4 is moved downward to bring the wafer 6 in contact with the polishing cloth 3. At the same time, a polishing slurry is dropped on the polishing cloth 3 through a nozzle 5.

While the wafer 6 is suitably moved on the polishing cloth 3 in such a state as to be pressed on the polishing cloth 3, the interlayer insulating film 11 on the wafer 6 is polished until the conductive layers 10*a* and 10*b* are exposed. After an elapse of a specified time, as shown in FIG. 2(*b*), the polishing of the interlayer insulating film 11 is completed and the surface of the wafer 6 is planarized, and concurrently the conductive layers 10*a* and 10*b* are exposed.

After that, as shown in FIG. 2(*c*), the upper interconnection layers 12*a* and 12*b* are formed in such a manner as to be respectively connected to the exposed conductive layers 10*a* and 10*b*, and thereby the lower interconnection layer 9 is connected to the upper interconnection layers 12*a* and 12*b*.

According to the above method for polishing of the related art, however, it is difficult to continue applying a uniform pressure over a whole surface of the wafer 6 through the wafer holder 4 while polishing. Such an unbalanced pressure results in an uneven thickness of the residual interlayer insulating film 11 through an unevenness of polishing volume over an entire surface of the wafer 6.

Thus, as shown in FIG. 3, there might arise a part where a thickness of the remaining interlayer insulating film 11 becomes thinner, as a result when forming an upper interconnection layer there is a risk that a dielectric strength lowers between the upper interconnection layer and the lower interconnection layer, or in the worst case, the upper interconnection layer and the lower interconnection layer short-circuit.

In order to avoid such a risk, the polishing surface of the wafer 6 can be observed midway through polishing. This results, however, in declination of throughput through some added processes including the observation by a microscope and the cleaning process of the wafer 6.

SUMMARY OF THE INVENTION

An object of the present invention is to provided an apparatus and a method for polishing in which it is possible to polish a substance uniformly over a whole surface of a wafer without observing the polished surface of the wafer halfway through polishing.

In an apparatus and a method for polishing of the present invention, a wafer having current detective patterns of conductors directly contacted with a semiconductor substrate, and an insulating film covering the current detective patterns is held by a wafer holder with conductivity and the insulating film is polished by a polisher in which a supporting plate with conductivity is exposed in openings through a polishing cloth while supplying a polishing slurry containing ions. Accordingly, when any of the current detective patterns on the wafer has been exposed by polishing the insulating film, a current is allowed to flow between the polisher and the wafer holder by way of the current detective pattern and the semiconductor substrate by the interposition of ions in the abrasive entering in the openings through the polishing cloth. On the other hand, the current is not allowed to flow to the portion in which the remaining insulating film is thicker than the specified film thickness and covers the current detective patterns. Accordingly, by polishing while monitoring the current, it is possible to specify the thicker portion than the specified film thickness and to enlarge the polished volume by increasing the pressure applied to this portion.

In particular, by taking the current-flowing area of a reference current detective pattern as x and taking the current flowing areas of the other current detective patterns as $X^n$ ($x \geqq 2$, n is an integer), different values of total current can be necessarily obtained even if any of current detective patterns are allowed to be conductive. For example, the relationship that X=2, and n=0, 1, 2, 3, 4. . . is preferable. Because it makes $X^n$=1, 2, 4, 8, 16. . . Thus, it is possible to specify any of the current detective patterns through which a current flows.

Since the polished volume can be partially adjusted by monitoring of the current, it is possible to eliminate the observation of the polishing surface of the wafer midway through polishing, which has been performed in the related art. Thus, the processes are simplified and the uniformity in polishing is improved.

Secondarily, a wafer with conductive layers and an insulating film covering the conductive layers is contacted with a polisher, which has a plurality of through-holes for allowing the passing of the abrasive containing ions and a pair of electrodes provided in the through-holes, and the insulating film is polished.

Accordingly, when the conductive layers are exposed on the surface of the wafer through polishing the insulating film, a current is allowed to flow by way of the one electrode, the conductive layer and the other electrode by the interposition of ions contained in the abrasive. Consequently, by monitoring of the current, it is possible to securely remove the insulating film on the conductive layers to expose the conductive layers, and to securely leave the insulating film with a specified film thickness.

Thus, it is possible to adjust the polished volume while monitoring the current, and hence to eliminate the observation of the polishing surface of the wafer through polishing. This makes it possible to simplify the processes and to improve the uniformity in polishing. Further, in the apparatus for polishing, there is provided a turnable wafer holder supported by a shaft and a polishing cloth with an asymmetric area. Additionally, the larger area portion of the polishing cloth is disposed near the shaft while the smaller area portion of the polishing cloth is disposed apart from the shaft. The polishing speed is generally increased in proportion to the relative speed between the polishing cloth and a substance to be polished. Further, when the wafer holder is turned, the polishing speed per unit area is larger at the outer peripheral portion than at the inner peripheral portion.

Accordingly, when the wafer is turned, the area in the surface of the wafer with which the polishing cloth contacts per unit time is approximately constant both on the inner side and on the outer side. Consequently, since the unevenness of the polished volume within the contact surface of the polishing cloth becomes less, by combination with the current detecting means, it is possible to further uniformly polish the insulating film on the wafer. Further, only by moving the polisher in the direction perpendicular to the turning direction of the wafer holder, it is possible to uniformly polish the whole surface of the wafer.

By rotating both the wafer holder and the polisher with same angular speed in the same direction, it is possible to equalize the relative speed between the wafer holder and the polisher over the surface of the wafer. Accordingly, by combination with the current detecting means, it is possible to uniformly polish the insulating film on the wafer.

Further, by decreasing the turning speeds of the wafer holder and the polisher when the detected current is large, and by increasing the turning speeds of the wafer holder and the polisher when the detected current is small, it is possible to further equalize the polished volume over the surface of the wafer. This is because, the higher the turning speed is, the larger the polishing speed is, and the lower the turning speed is, the smaller the polishing speed is.

Additionally, by reducing the pressure to the polisher when the detected current is large, and by enlarging the pressure to the polisher when the detected current is small, it is possible to further equalize the polished volume over the surface of the wafer. This is because, the larger the pressure is, the larger the polishing speed is, and the smaller the pressure is, the smaller the polishing speed is.

BRIEF DESCRIPTION OF THE DRAWING

FIG. 1(*b*) is a top view of a polisher of the apparatus for polishing;

FIG. 4(*b*) is a top view of a polisher of the apparatus for polishing;

FIG. 5(*b*) is a sectional view taken along the line A—A of the semiconductor device;

FIG. 6(*b*) shows the case in which the current detective pattern of B is first exposed and then the current detective patterns of A, C, D and E are concurrently exposed;

FIG. 9(*b*) is an explanatory view for the result of examining the average film thickness between wafers with respect to an interlayer insulating film remaining by polishing using the method for polishing according to the first embodiment of the present invention;

FIG. 12(*b*) is a side view of the polisher;

FIG. 15(*b*) is an enlarged sectional view.

DESCRIPTION OF THE PREFERRED EMBODIMENT (1) Explanation of an apparatus for polishing and a method for polishing according to a first embodiment of the present invention (i) Explanation of the apparatus for polishing according to the first embodiment of the present invention The apparatus for polishing according to the first embodiment of the present invention will be described with reference to FIG. 4(*a*) and FIG. 4(*b*).

Figure 1A:
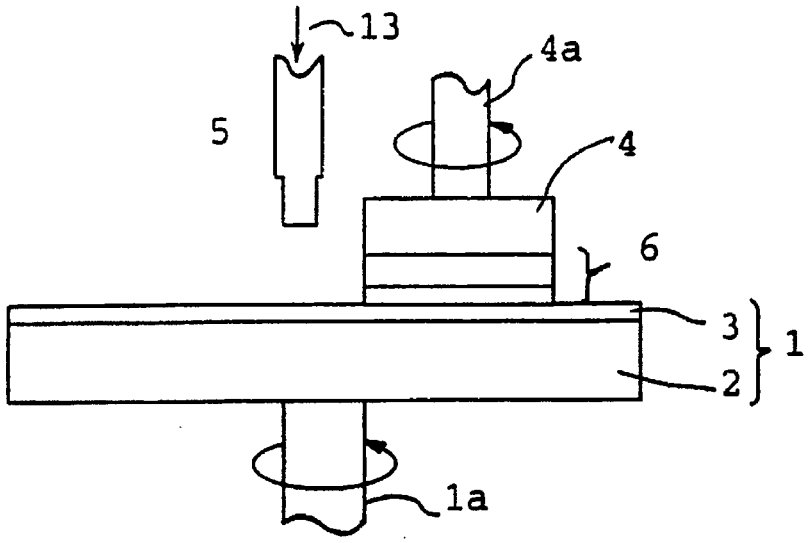
FIG. 1(a) (Related Art)
FIG. 1(*a*) and FIG. 1(*b*) are construction views of an apparatus for polishing used for a method for polishing according to the related art, wherein FIG. 1(*a*) is a side view of the apparatus for polishing.
Figure 1B:
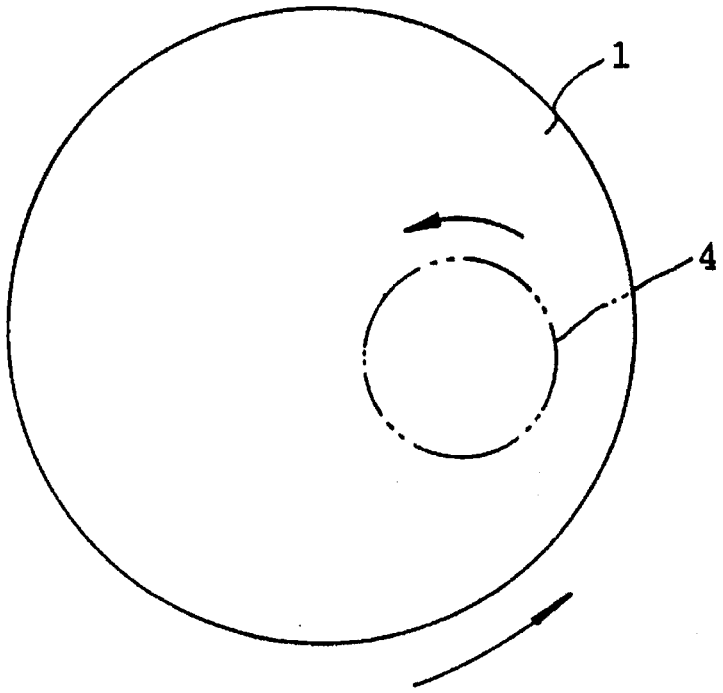
FIG. 1(b) (Related Art)
Figure 2A:
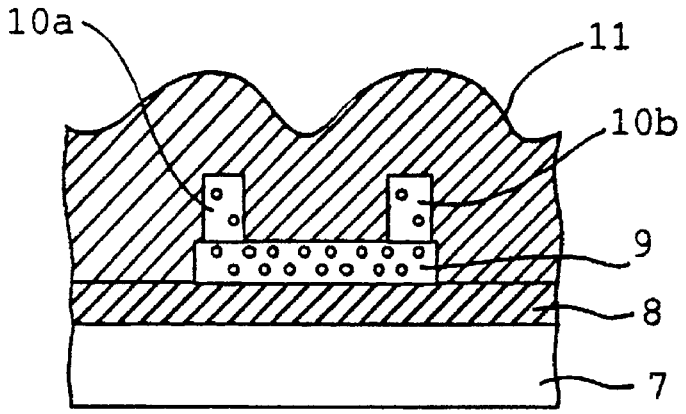
FIG. 2(a) (Related Art)
FIG. 2(*a*) to FIG. 2(*c*) are sectional views for explaining a method for manufacturing a semiconductor device including the method for polishing according to the related art.
Figure 2B:
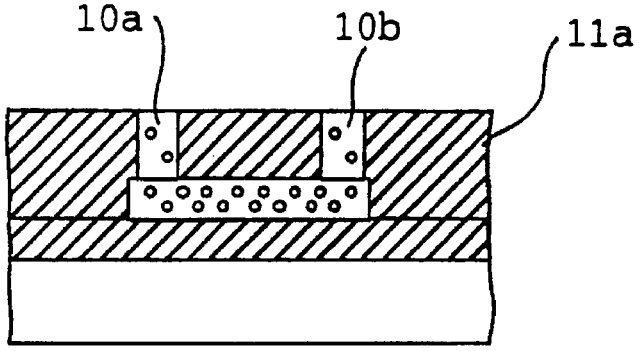
FIG. 2(b) (Related Art)
Figure 2C:
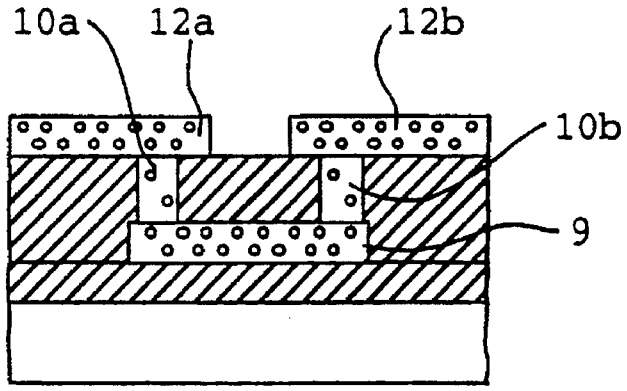
FIG. 2(c) (Related Art)
Figure 3:
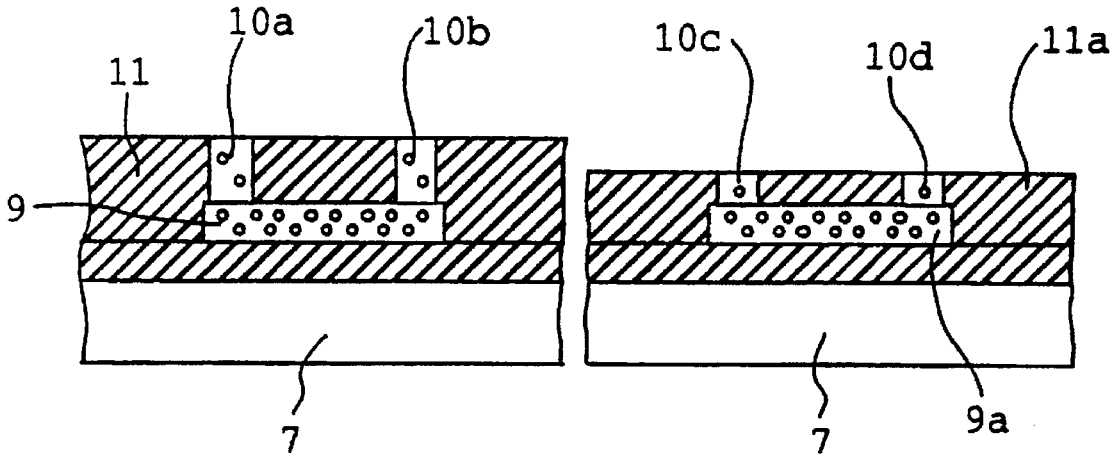
FIG. 3 (Related Art)
FIG. 3 is a sectional view for explaining the uniformity in polishing by the method for polishing according to the related art.
Figure 4:
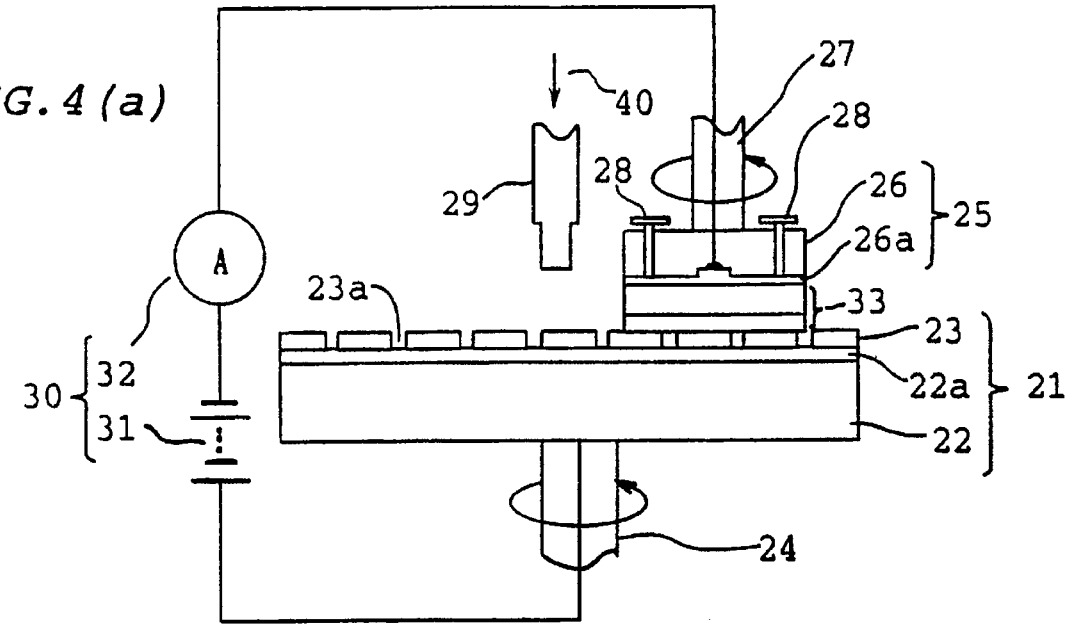
FIG. 4(*a*) and FIG. 4(*b*) are construction views of an apparatus for polishing used for a method for polishing according to a first embodiment of the present invention, wherein FIG. 4(*a*) is a side view of the apparatus for polishing.
Figure 4:
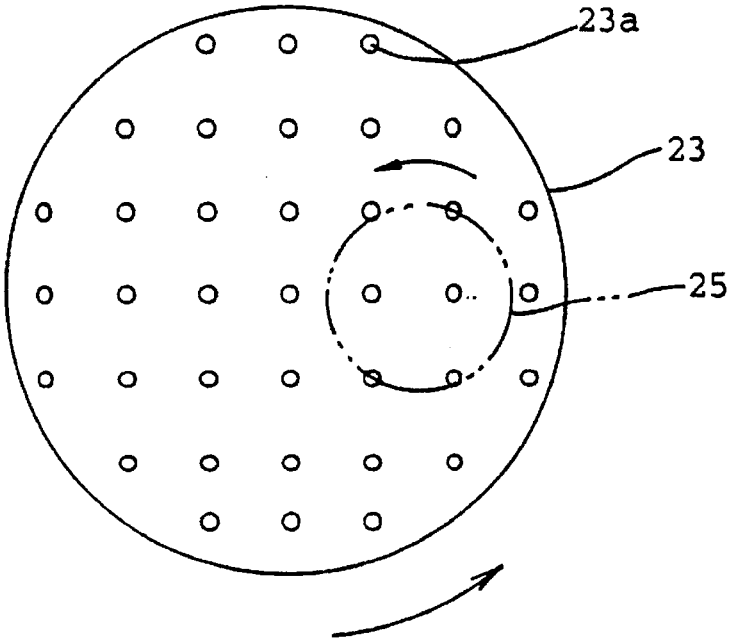

In FIG. 4(*a*) and FIG. 4(*b*), reference numeral 21 is a polisher having a disk-like supporting plate 22 which is capable of turning on an shaft 24 perpendicular to a polishing surface. A first conductive film 22*a* is formed on the polishing surface of the supporting plate 22, and a polishing cloth 23 is stuck on the first conductive film 22*a*. Further, a plurality of openings 23*a* are formed through the polishing cloth 23, and the first conductive film 22*a* is exposed on the bottom portions of the openings 23*a*.

Reference numeral 25 indicates a disk-like wafer holder for holding and fixing a wafer 33 with a lower interconnection layer and an interlayer insulating film covering the lower interconnection layer. The diameter of the wafer 33 is smaller than that of the wafer holder 25. The wafer holder 25 turns on a shaft 27 perpendicular to a wafer holding surface. Further, a second conductive film 26*a* is formed on a wafer holding surface of a supporting plate 26. Additionally, a plurality of pressure adjusting screws 28 are screwed from the rear surface of the supporting plate 26. The necessary pressure adjusting screw 28 is loosened or fastened to apply a pressure to a necessary portion of a wafer 33 from the rear surface.

Reference numeral 29 indicates a nozzle (abrasive supply means) for supplying a polishing slurry 40 containing colloidal silica. The abrasive 40 contains ions such as Na ion and K ion.

Reference numeral 30 indicates a current detecting means, which includes a power supply 31 for supplying a voltage and an ammeter 32. The current detecting means 30 is connected between the first conductive film 22*a* of the polisher 21 and the second conductive film 26*a* of the wafer holder 25.

As described above, according to the apparatus for polishing, the first conductive film 22*a* is stuck on the polishing surface of the polisher 21, and the second conductive film 26*a* is stuck on the wafer holding surface of the wafer holder 25. Further, the openings 23*a* are formed through the polishing cloth 23 on the first conductive film 22*a* of the polisher 21. Additionally, the nozzle 29 for supplying the abrasive 40 containing ions is provided.

With this construction, in the case of holding on the wafer holder 25 the wafer 33 with the interlayer insulating film 37 covering the current detective patterns 36*a* to 36*d* and the lower interconnection layer, and polishing the interlayer insulating film 37 in a state of contacting the wafer 33 with the polishing cloth 23 and pressing the wafer 33 to the polishing cloth 23, when any of the current detective patterns 36*a* to 36*d* is has been exposed by polishing the interlayer insulating film 37, a current is allowed to flow between the polisher 21 and the wafer holder 25 through the first conductive film 22*a*, the exposed current detective patterns 36*a* to 36*d*, a semiconductor substrate 34 and the second conductive film 26*a* by the interposition of the ions in the abrasive 40 entering in the openings 23*a*.

Accordingly, since the polishing surface of the wafer 33 is confirmed by monitoring of the current, it is possible to eliminate the observation of the polishing surface of the wafer 33 midway through polishing. This simplifies the processes and improves the uniformity in polishing.

(ii) Explanation of a method for polishing according to the first embodiment of the present invention A semiconductor device used in the method for polishing according to the first embodiment of the present invention will be described with reference to FIG. 5(*a*) and FIG. 5(*b*).

Figure 5:
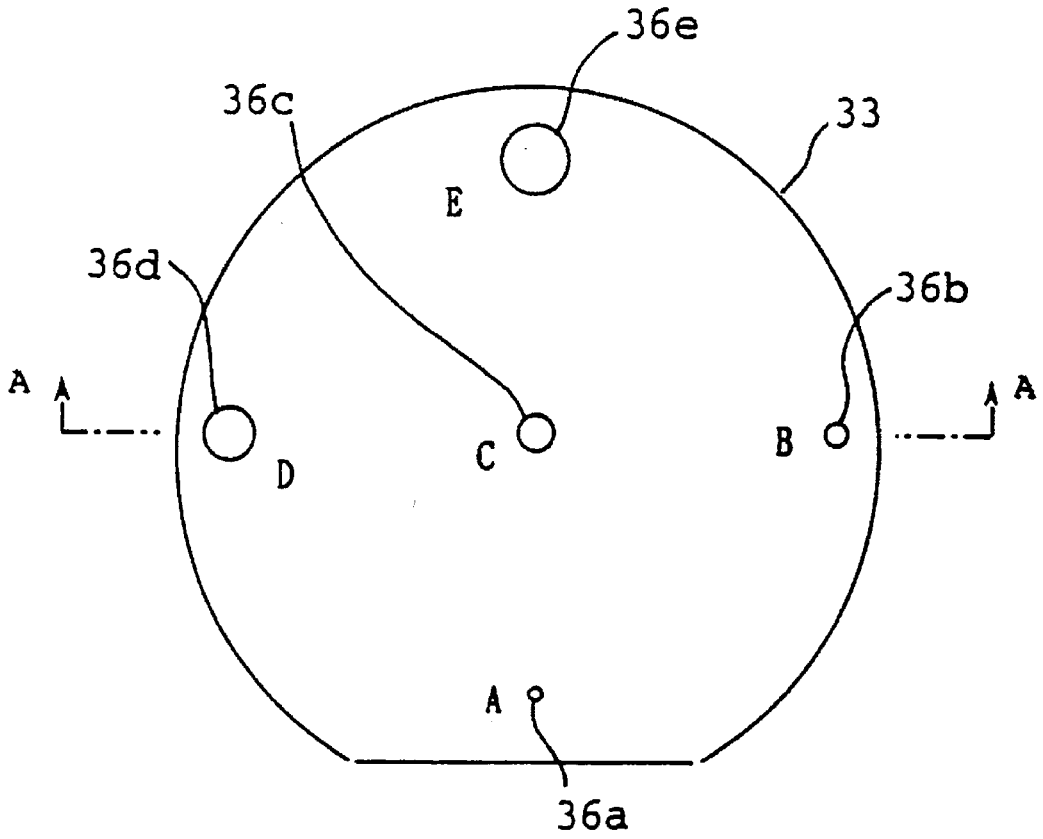
FIG. 5(*a*) and FIG. 5(*b*) are explanatory views of a semiconductor device used in the method for polishing according to the first embodiment of the present invention, wherein FIG. 5(*a*) is a top view of the semiconductor device.
Figure 5:
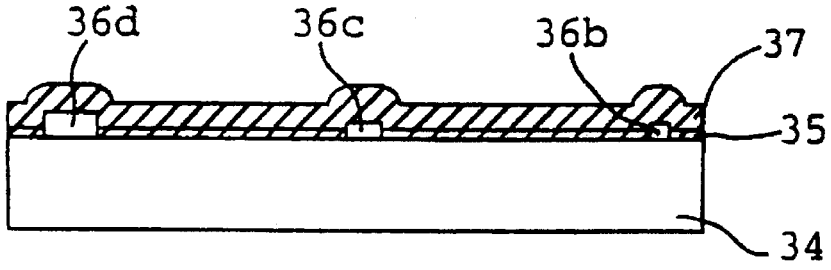

In FIG. 5(*a*) and FIG. 5(*b*), reference numeral 34 indicates a semiconductor substrate, for example of silicon; 35 is a backing insulating film formed on the semiconductor substrate 34; 36*a* to 36*e* are current detective patterns, each being formed of a cylindrical tungsten (W) film, which are formed on the central portion of the wafer 33 by one point (C) and on the peripheral portion by four points (A, B, D, E). The current detective patterns 36*a* to 36*e* are directly connected to the semiconductor substrate 34 through openings of the backing insulating film 35. The current flowing areas of the current detective patterns 36*a* to 36*e* are specified as follows: assuming that the current flowing area of the current detective pattern 36*a* at the portion A is taken as 1, those of the current detective patterns 36*b* to 36*e* at the portions B, C, D and E become 2, 4, 8, 16, respectively. The reason why the current flowing areas are taken as 1, 2, 4, 8, 16 is that the current detective patterns are specified such that even if a plurality of arbitrary current detective patterns are allowed to be conductive, the values of total current obtained are necessarily different from each other.

Next, the method for polishing according to the first embodiment of the present invention using the above apparatus for polishing and the semiconductor device will be described with reference to FIG. 6(*a*), FIG. 6(*b*), FIG. 7(*a*) to FIG. 7(*c*), FIG. 4(*a*), FIG. 4(*b*), FIG. 5(*a*), and FIG. 5(*b*).

Figure 7:
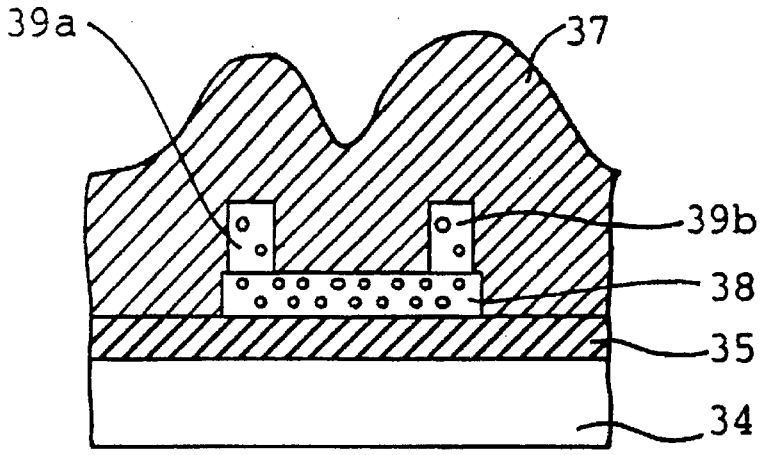
FIG. 7(*a*) to FIG. 7(*c*) are sectional views for explaining a method for manufacturing a semiconductor device including the method for polishing according to the first embodiment of the present invention.
Figure 7:
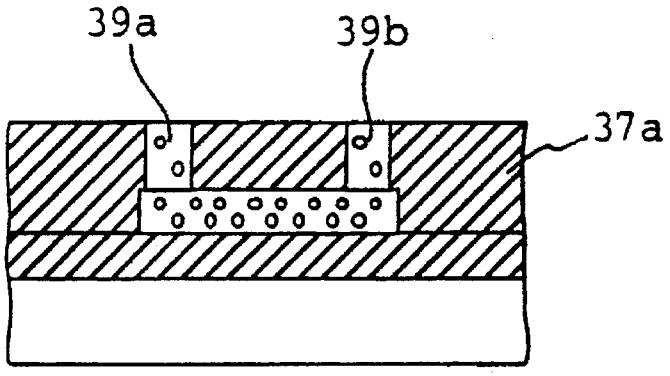
Figure 7:
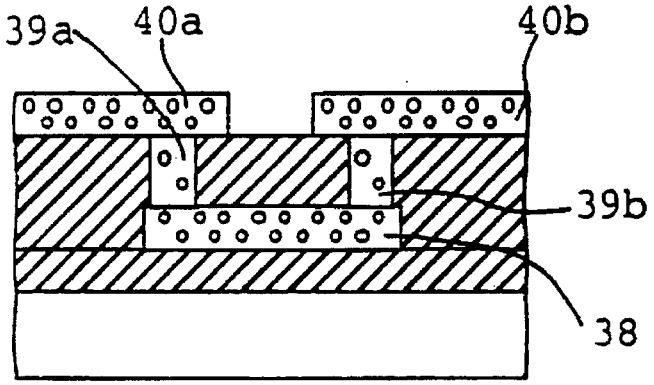

FIG. 7(*a*) shows the state where a lower interconnection layer and an interlayer insulating film are formed but the polishing is not performed. In this figure, reference numeral 34 indicates a semiconductor substrate made from silicon; 35 is a backing insulating film formed of a silicon oxide film on the semiconductor substrate 34; 38 is a lower interconnection layer of aluminum on the backing insulating film 35; 39*a* and 39*b* are conductive layers formed of cylindrical aluminum for connecting an upper interconnection layer formed later to the lower interconnection layer 38, which are formed at two points on the lower interconnection layer; and 37 is an interlayer insulating film (insulating film) of a silicon oxide film covering the lower interconnection layer 38 and the conductive layers 39*a* and 39*b*.

In such a state, first, the wafer 33 is held and fixed on the wafer holder 25 as shown in FIG. 4(*a*) such that the surface of the wafer 33 formed with the interlayer insulating film 37 is directed to the front side. Subsequently, the surface of the wafer 33 is opposed to the surface of the polishing cloth 23 in parallel to each other. After that, both the wafer holder 25 and the polisher 21 are turned in the same direction, and concurrently the wafer holder 25 is moved downward or the polisher 21 is moved upward, to thus bring the wafer 33 in contact with the polishing cloth 23. At the same time, the abrasive 40 is dropped on the polishing cloth 23 through the nozzle 29.

The wafer 33 is suitably moved on the polishing cloth 23 in such state as to be pressed thereon, and the interlayer insulating film 37 is polished. At this time, the ammeter 32 is monitored. When the polishing proceeds somewhat and one current detective pattern 36*b* is exposed, as shown in FIG. 6(*a*), a current corresponding to the current flowing area 2 is allowed to flow, which is detected by the ammeter 32. Accordingly, the portions other than the portion B is relatively strongly pressed.

Figure 6:
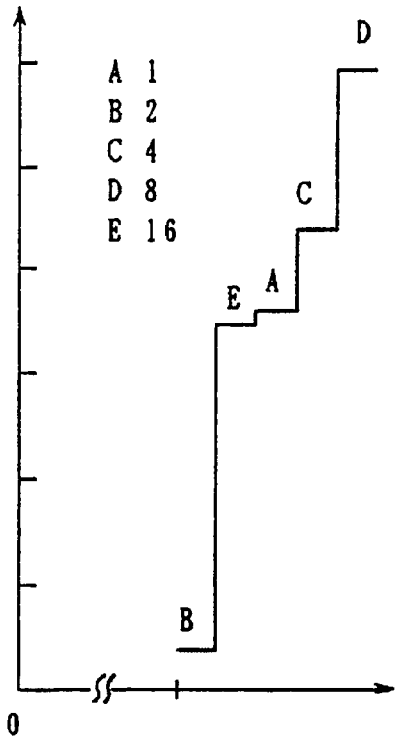
FIG. 6(*a*) and FIG. 6(*b*) are explanatory views for explaining a change in monitoring current with time in the method for polishing according to the first embodiment of the present invention; wherein FIG. 6(*a*) shows the case in which current detective patterns are exposed in order of B, E, A, C and D.
Figure 6:
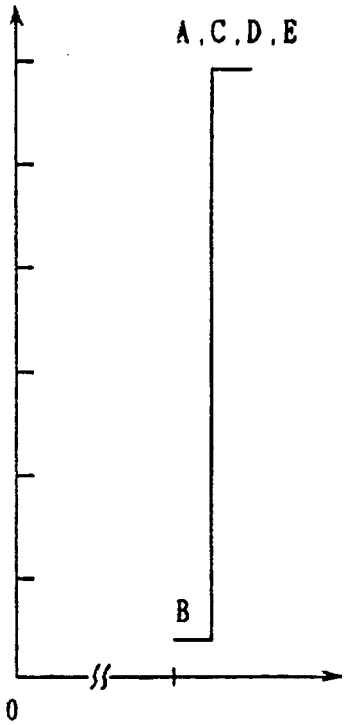

When the polishing proceeds and the current detective pattern 36e is exposed, as shown in FIG. 6 (*a*), a current corresponding to the current flowing areas (2+16) is allowed to flow, which is detected by the ammeter 32. Accordingly, the portions other than the portions B and E are relatively strongly pressed.

When the polishing further proceeds and the current detective pattern 36*a* is newly exposed, as shown in FIG. 6(*a*), a current corresponding to the current flowing areas (2+16+1) is allowed to flow, which is detected by the ammeter 32. Accordingly, the portions other than the portions B, E and A are relatively strongly pressed. When the polishing proceeds and the current detective pattern 36*c* is next exposed, as shown in FIG. 6(*a*), a current corresponding to the current flowing areas (2+16+1+4) is allowed to flow, which is detected by the ammeter 32. Accordingly, the periphery of the portion D other than the portions B, E, A and C is relatively strongly pressed.

When the polishing further proceeds and the current detective pattern 36*d* is next exposed, as shown in FIG. 6(*a*), a current corresponding to the current flowing areas (2+16+1+4+8) is allowed to flow, which is detected by the ammeter 32. Thus, it is judged that the current detective patterns 36*a* to 36*e* are all allowed to be conductive and the specified polishing volume is achieved, thus completing the polishing.

In addition, in the case of FIG. 6(*b*), differently from the case described above, first, the current detective pattern 36*b* at the portion B is allowed to be conductive, after which the current detective patterns 36*a*, and 36*c* to 36*e* are concurrently allowed to be conductive.

Figure 8:
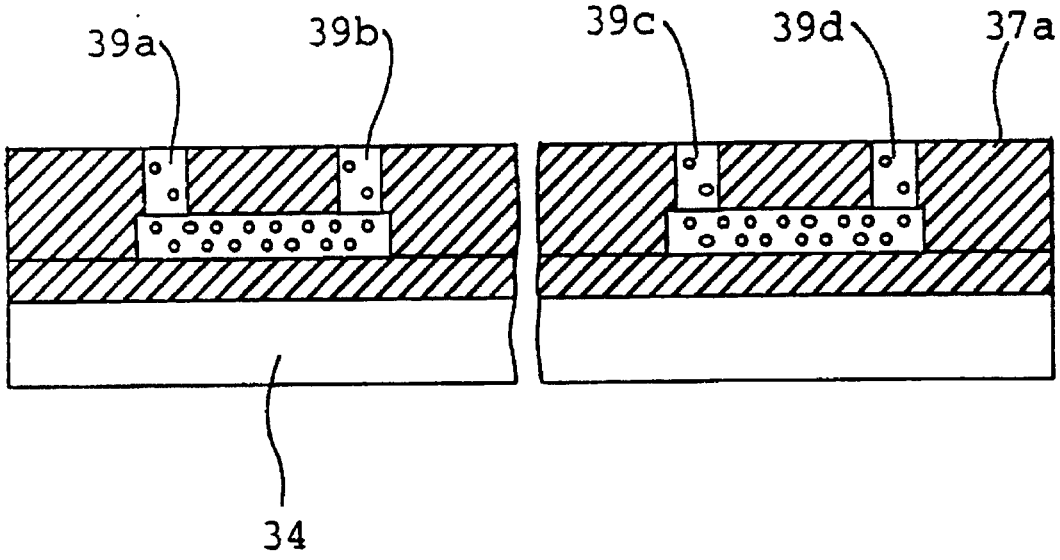
FIG. 8 is a sectional view for explaining the uniformity in polishing by the method for polishing according to the first embodiment of the present invention.

Thus, the interlayer insulating film 37 in a specified amount is uniformly polished over a whole surface of the wafer 33, so that the surface of the wafer 33 is planarized. And, as shown in FIG. 7(*b*) and FIG. 8, the conductive layers 39*a* to 39*d* are exposed on the whole surface of the wafer 33.

After that, as shown in FIG. 7(*c*), upper interconnection layers 40*a* and 40*b* are formed so as to be respectively connected to the exposed conductive layers 39*a* and 39*b*, and thereby the lower interconnection layer 38 is connected to the upper interconnection layers 40*a* and 40*b* through the conductive layers 39*a* and 39*b*.

Figure 9:
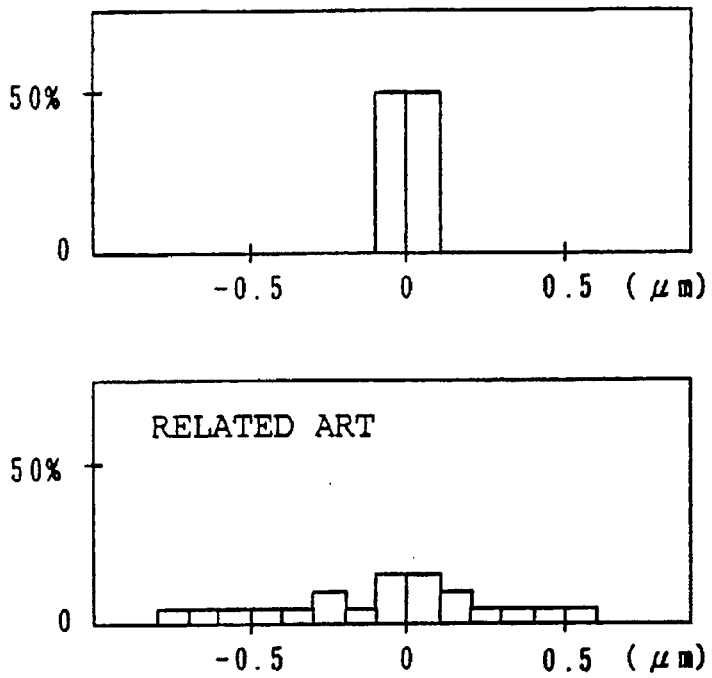
FIG. 9(*a*) is an explanatory view for the result of examining the unevenness in the film thickness over a wafer with respect to an interlayer insulating film remaining by polishing using the method for polishing according to the first embodiment of the present invention.
Figure 9:
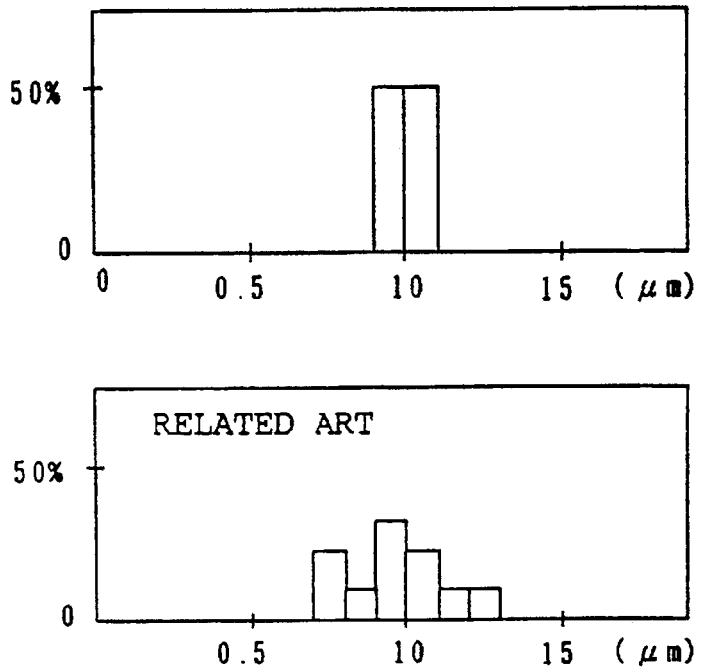

As for the interlayer insulating film 37*a* remaining after polishing in the manner as described above, the unevenness of the film thickness within the wafer 33 and the average film thickness between the wafers 33 were examined, which gave the results as shown in FIG. 9(*a*) and FIG. 9 (*b*).

According to the above examination results, the unevenness of the film thickness within the wafer 33 and the average film thickness between the wafers were significantly improved as compared with the related art.

As described above, according to the method for polishing according to the first embodiment of the present invention, it is possible to check the polished volume at the specified portion within the wafer 33 while monitoring the ammeter 32, and hence to equalize the polished volume by adjustment of the pressure applied on the necessary portion.

Thus, as for the interlayer insulating film 37*a* remaining after polishing, the unevenness of the film thickness of the wafer 33 and the average film thickness between the wafers are significantly improved as compared with the related art. Further, the observation of the wafer 33 midway through polishing is eliminated, thereby simplifying the processes.

Additionally, in the first embodiment, the pressure adjusting screws 28 are provided to manually adjust a pressure; however, by providing the pressure adjusting means capable of automatically adjusting a pressure and by interlocking the current detecting means 30 with the pressure adjusting means, it is possible to automatically adjust a pressure while continuing the polishing.

(2) Explanation of an apparatus for polishing and a method for polishing according to a second embodiment of the present invention (i) Explanation of the apparatus for polishing of the second embodiment of the present invention (A) First example The apparatus for polishing according to the second embodiment of the present invention will be described with reference to FIG. 10(*a*), FIG. 10(*b*) and FIG. 11.

Figure 10:
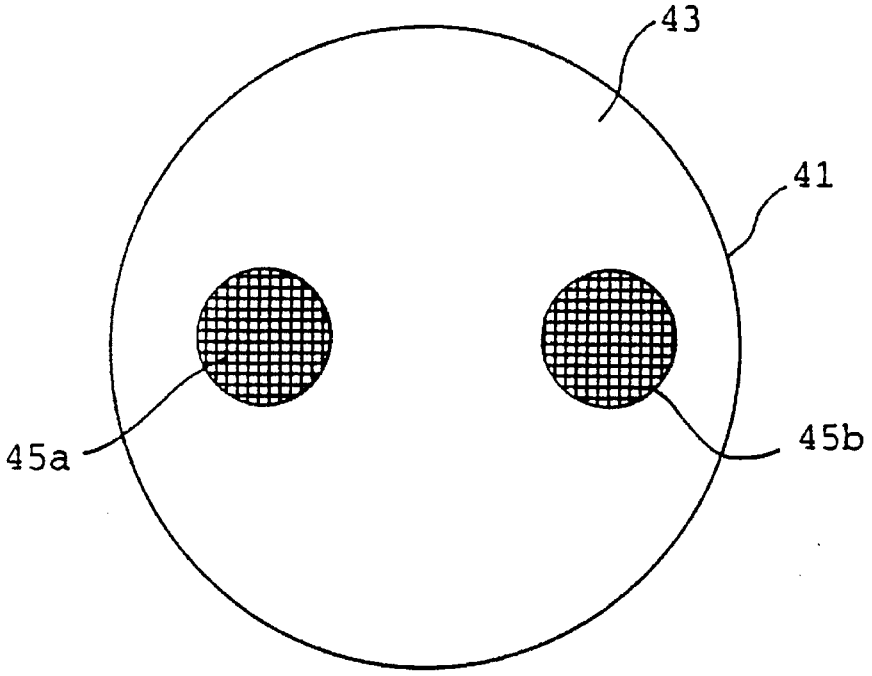
FIG. 10(*a*) and FIG. 10(*b*) are detail construction views of a polisher of an apparatus for polishing used in a method for polishing according to a second embodiment of the present invention, wherein FIG. 10(*a*) is a bottom view and FIG. 10(*b*) is a side view.
Figure 10:
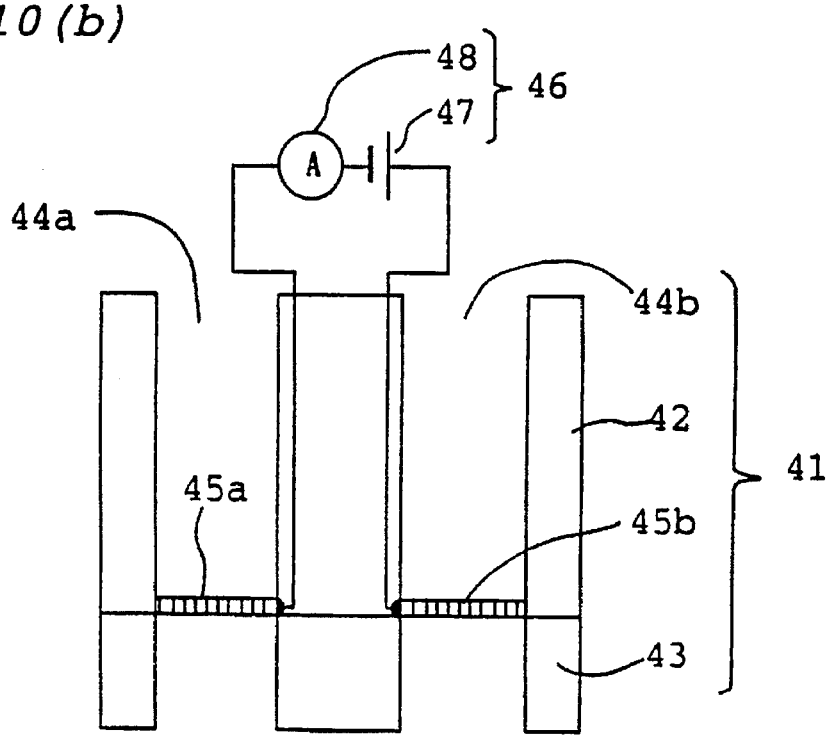

In FIG. 10(*a*) and FIG. 10(*b*), reference numeral 41 indicates a polisher having a disk-like supporting plate which is capable of turning on a shaft perpendicular to a polishing surface. On the surface of the polisher 41, a polishing cloth 43 is formed and two through-holes 44*a* and 44*b* for allowing the passing of a polishing slurry such as colloidal silica containing Na ion and K ion are formed. In addition, meshed electrodes 45*a* and 45*b* are provided in the through-holes 44*a* and 44*b*, respectively. A power supply 47 and an ammeter 48 which constitute a current detecting means 46 are connected in series to a pair of the electrodes 45*a* and 45*b*.

Figure 11:
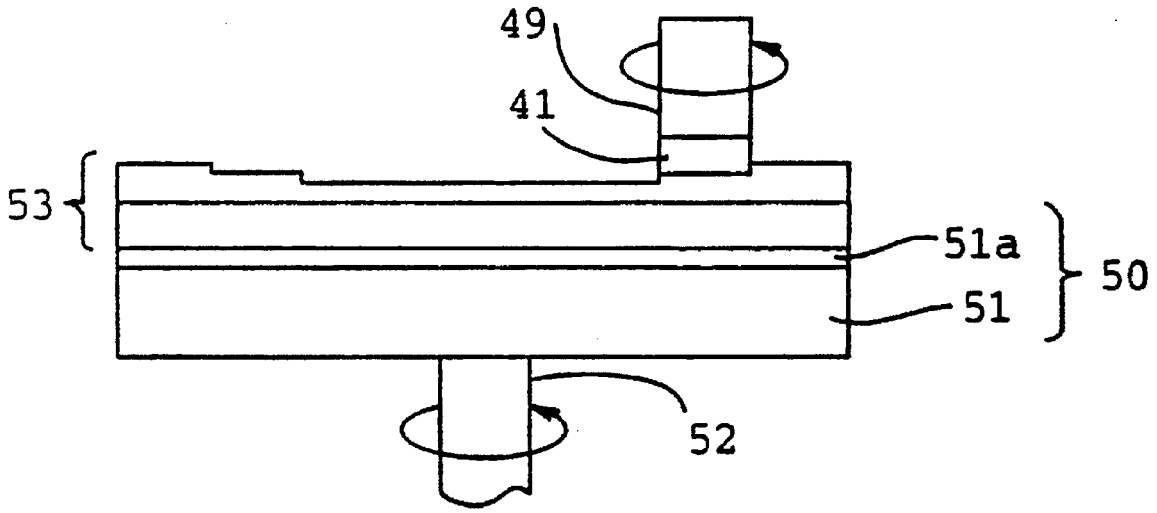
FIG. 11 is a side construction view of the apparatus for polishing used in the method for polishing according to the second embodiment of the present invention.

In FIG. 11, reference numeral 49 indicates a rotating shaft of the polisher 41; 50 is a disk-like wafer holder for holding and fixing a wafer 50 with an interlayer insulating film as a substance to be polished on a wafer holding surface opposed to the polishing cloth 43 of the polisher 41. The diameter of the wafer holder 50 is larger than that of the polisher 41. The wafer holder 50 is turned on a shaft 52 perpendicular to a wafer holding surface. Further, a vacuum chuck for fixing the wafer 53 is formed on the wafer holding surface.

Figure 13:
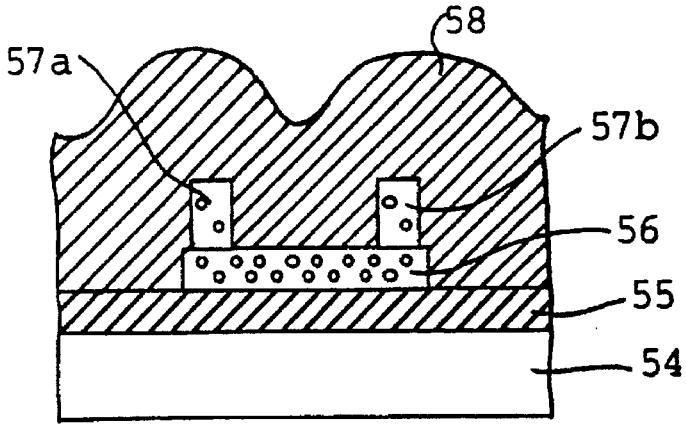
FIG. 13(*a*) to FIG. 13(*c*) are sectional views for explaining a method for manufacturing a semiconductor device including the method for polishing according to the second embodiment of the present invention.
Figure 13:
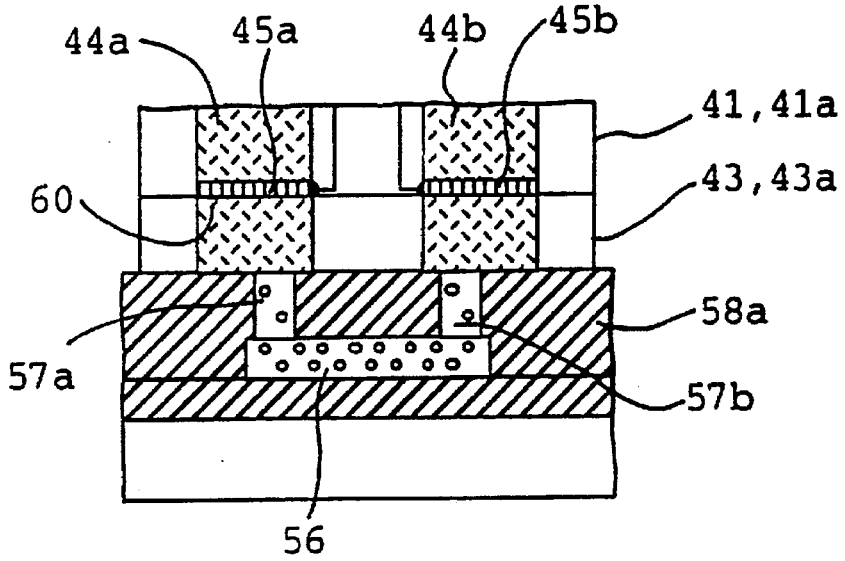
Figure 13:
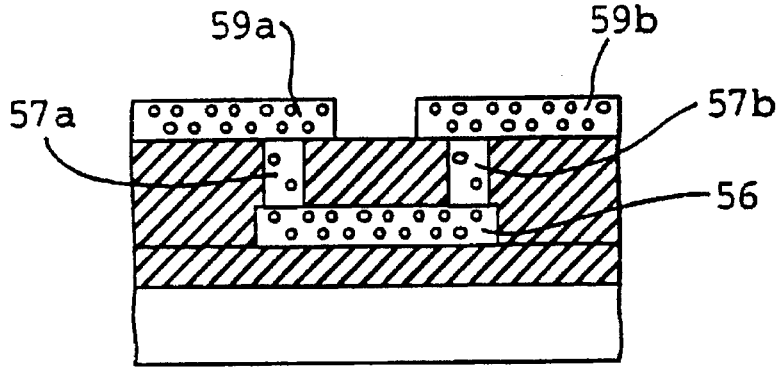

In addition, as shown in FIG. 13(*a*), the wafer 53 has a backing insulating film 55 formed of a silicon oxide film on a semiconductor substrate 54, a lower interconnection layer 56 of aluminum on the backing insulating film 55, conductive layers 57*a* and 57*b* of cylindrical aluminum which are formed at two points on the lower interconnection layer 56 to connect upper inter connection layers formed later to the lower interconnection layer 56, and an interlayer insulating film (insulating film) 58 formed of a silicon oxide film covering the lower interconnection layer 56 and the conductive layers 57*a* and 57*b*. The semiconductor substrate 54 and the backing insulating film 55 constitute a substrate.

As described above, according to the apparatus for polishing, the two through-holes 44*a* and 44*b* for supplying the abrasive 60 are formed in the polisher 41, and the meshed electrodes 45*a* and 45*b* are respectively provided in the through-holes 44*a* and 44*b*. The power supply 47 and the ammeter 48 are connected in series to a pair of the electrodes 45*a* and 45*b*. Further, the abrasive 60 contains ions.

Thus, when the conductive layers 57*a* and 57*b* are exposed on the surface of the wafer 55 through polishing the interlayer insulating film 58, a current is allowed to flow to the ammeter 48 by way of the one electrode 45*b*, the conductive layer 57*b*, the lower interconnection layer 56 and the conductive layer 57*a* and the other electrode 45*a* by the interposition of ions contained in the abrasive 60.

This makes it possible to adjust the polished volume by monitoring the current, and hence to eliminate the observation of the polishing surface of the wafer 53 midway through polishing, which has been performed in the related art. Consequently, the process is simplified and the uniformity in polishing is improved whereby the interlayer insulating film 58*a* with a specified film thickness certainly remains.

In addition, in the above embodiment, the two through-holes 44*a* and 44*b* are provided; however, three or more through-holes may be provided. In this case, one electrode provided in the specified through-hole is connected to a positive or negative terminal of the power supply 47, and the electrodes provided in the other through-holes are all connected to the negative or positive terminals of the power supply 47. Alternatively, a plurality of the electrodes in one group are connected to positive or negative terminals of the power supply 47 and a plurality of the electrodes in the other group are connected to negative or positive terminals.

(B) Second example

An apparatus for polishing according to a second example of the second embodiment of the present invention will be described with reference to FIG. 12(*a*) and FIG. 12(*b*).

Figure 12:
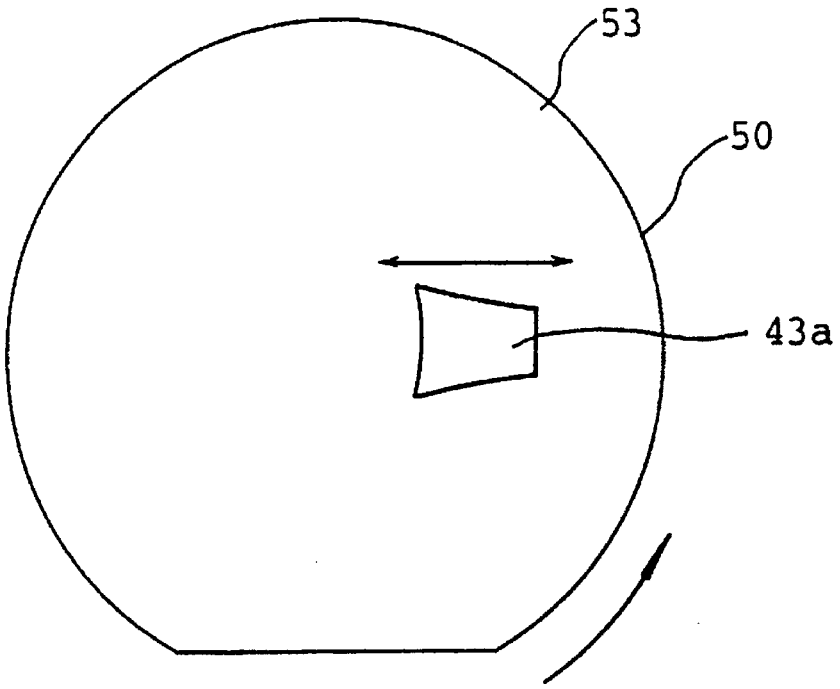
FIG. 12(*a*) and FIG. 12(*b*) are detail construction views of a polisher of the apparatus for polishing according to the second embodiment of the present invention, wherein FIG. 12(*a*) is a plan view showing the position of the polisher on a wafer.
Figure 12:
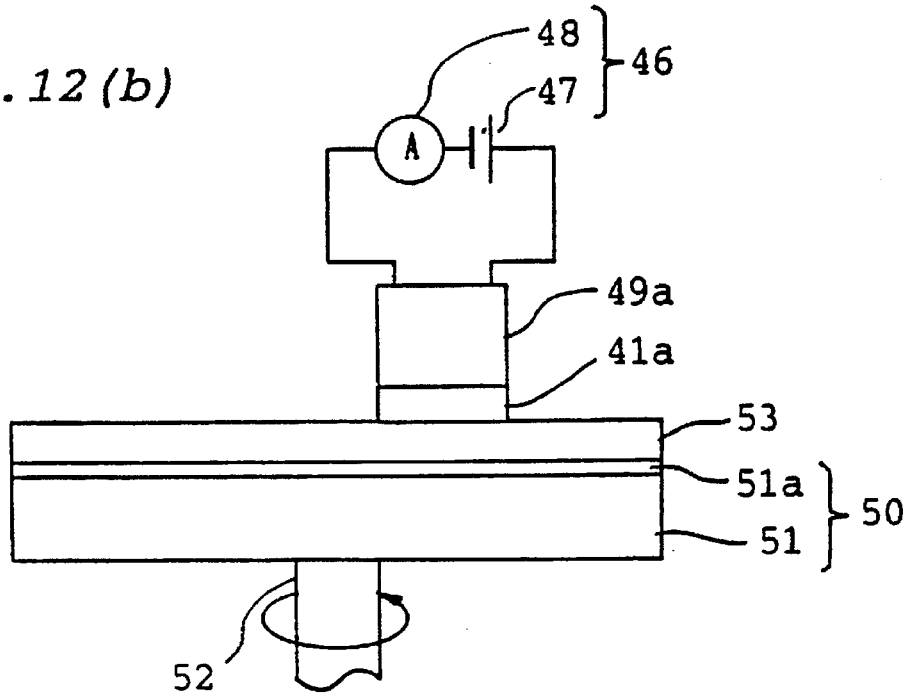

In FIG. 12(*a*) and FIG. 12(*b*), reference numeral 41*a* indicates a polisher formed with a polishing cloth 43*a* on a polishing surface and having a disk-like supporting plate which is capable of turning on a shaft perpendicular to a polishing surface. Further, the polisher 41*a* has a plurality of through-holes (not shown) for allowing the passing of a polishing slurry such as colloidal silica containing Na ion and K ion. Meshed electrodes are provided in the through-holes. A power supply 47 and an ammeter 48 (current detecting means 46) are connected in series to a pair of the electrodes. The above construction is substantially similar to that in the first example.

The second example is different from the first example in that the polishing cloth is asymmetrically formed, and over the wafer holder 50, the portion of the polishing cloth 43*a* with a larger area is disposed near the central portion of the wafer holder 50 while the portion of the polishing cloth 43*a* with a smaller area is disposed apart from the central portion of the wafer holder 50.

As for the other reference numerals, the same reference numerals as those in FIG. 11 designate the same parts as those in FIG. 11.

In the apparatus for polishing according to the second example of the present invention, the polishing cloth 43*a* is asymmetrically formed, and over the wafer holder 50, the portion of the polishing cloth 43*a* with a larger area is disposed near the central portion of the wafer holder 50 while the portion of the polishing cloth 43*a* with a smaller area is disposed apart from the central portion of the wafer holder 50. The polishing speed is generally increased in proportion to the relative speed between the polishing cloth and a substance to be polished. Further, as the wafer holder 47*a* is turned, the polishing speed per unit area is larger at the outer peripheral portion than at the inner peripheral portion.

Accordingly, in the apparatus for polishing of the second example, during the wafer 53 is turned, the area in the surface of the wafer 53 with which of the polishing cloth 43*a* contacts per unit time becomes approximately constant both on the inner side and the outer side. The polished volume of a substance to be polished during the polishing cloth 43*a* is moved along the circumference of the wafer 53 becomes approximately constant both on the inner side and the outer side of the polishing cloth 43*a*, so that it is possible to reduce the unevenness of the polished volume within the wafer 53. Consequently, in combination with the current detecting means, it is possible to further uniformly polish the substance to be polished on the wafer 53.

In addition, by only moving the polisher 41*a* in the direction perpendicular to the turning direction of the wafer holder 50, it is possible to uniformly polish the whole surface of the wafer 53.

Thus, it is possible to adjust the polished volume by monitoring of the current, and hence to eliminate the observation for the surface of the wafer 53 midway through polishing, which has been performed in the related art. Accordingly, the processes are simplified and the uniformity in polishing is improved.

(ii) Explanation of a method for polishing according to the second embodiment of the present invention (A) Application to a method for manufacturing a semiconductor device The method for polishing using the above apparatus for polishing according to the second embodiment of the present invention will be described with reference to FIG. 13(*a*) to FIG. 13(*c*), FIG. 14, FIG. 10(*a*), FIG. 10(*b*) and FIG. 11.

FIG. 13 (*a*) is a sectional view showing the state where a lower interconnection layer and an interlayer insulating film are formed but the polishing is not performed. In this figure, reference numeral 54 indicates a semiconductor substrate of silicon; 55 is a backing insulating film formed of a silicon oxide film on the semiconductor substrate 54; 56 is a lower interconnection layer of aluminum on the backing insulating film 55; 57*a* and 57*b* are conductive layers formed of column aluminum for connecting upper interconnection layers formed later to the lower interconnection layer 56, which are formed at two points on the lower interconnection layer 56; and 58 is an interlayer insulating layer (insulating film) formed of a silicon oxide film covering the lower interconnection layer 56 and the conductive layers 57*a* and 57*b*.

In such a state, first, as shown in FIG. 11, the wafer 53 is held and fixed by vacuum chuck on the wafer holder 50 in such a manner that the surface of the wafer having the interlayer insulating film 58 is directed to the front side. Subsequently, the wafer 53 is opposed to the polishing cloth 43 in such a manner that the surface of the interlayer insulating film 58 is in parallel to the surface of the polishing cloth 43. After that, the wafer holder 50 and the polisher 41 are turned with an equal angular speed in the same direction, and concurrently the wafer 53 is contacted with the polishing cloth 43 by moving upward the wafer holder 50 or moving downward the polisher 41. At the same time, a polishing slurry 60 is discharged on the wafer 53 through the through-holes 44*a* and 44*b* of the polisher 41.

As shown in FIG. 13(*b*), the polisher 41 polishes the interlayer insulating film 56 on the wafer 53 while being suitably moved on the wafer 53 in such a state as to be pressed on the wafer 53. At this time, since the wafer holder 50 and the polisher 41 are turned with an equal angular speed in the same direction, they are equal to each other in its relative speed, which enables uniform polishing irrespective of the location to be polished. Further, through polishing, the ammeter 48 is monitored. When the polishing proceeds somewhat, and the conductive layers 57*a* and 57*b* are exposed, a current is allowed to flow by way of the one electrode 45*b*, the conductive layer 57*b*, the lower conductive layer 56, the conductive layer 57*a* and the other electrode 45*a* by the interposition of ions contained in the abrasive 60, and the current is detected by the ammeter 48. Thus, the polishing of the contact portion by the polisher 41 is completed.

Subsequently, the polisher 41 is moved to the adjacent region, and the interlayer insulating film 58 is similarly polished, thus completing the polishing over the whole surface of the wafer 53.

Figure 14:
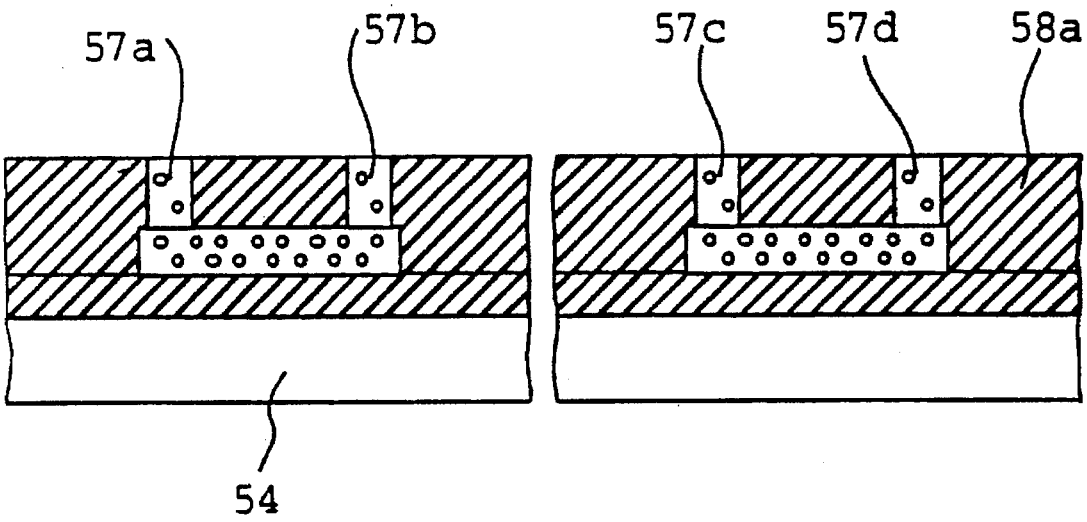
FIG. 14 a sectional view for explaining the uniformity of the polishing by the polishing method according to the second embodiment of the present invention.

As shown in FIG. 14, the interlayer insulating film 58*a* with a specified amount is thus polished over the whole surface of the wafer 53, and the surface of the wafer 53 is planarized. Consequently, the conductive layers 57*a* and 57*b* are exposed on the whole surface of the wafer 53.

After that, as shown in FIG. 13(*c*), when upper interconnection layers 59*a* and 59*b* are formed so as to be respectively connected with the exposed conductive layers 57*a* and 57*b*, the lower interconnection layer 57 is connected to the upper interconnection layers 59*a* and 59*b* through the conductive layers 57*a* and 57*b*.

As described above, according to the method for polishing of the second embodiment of the present invention, in the case that the wafer 53 is held by the wafer holder 50 and the interlayer insulating film 58 covering the lower interconnection layer 56 and the conductive layers 57*a* and 57*b* is polished, when the conductor layers 57*a* and 57*b* are exposed on the surface of the wafer through polishing, a current is allowed to flow to the ammeter 48 by way of the one electrode 45*b*, the conductive layer 57*b*, the lower interconnection layer 56, the conductive layer 57*a* and the other electrode 45*a* by the interposition of ions contained in the abrasive 60.

Accordingly, by monitoring of the current, the interlayer insulating film 58 on the conductive layers 57*a* and 57*b* can be certainly removed to expose the conductive layers 57*a* and 57*b*, and the interlayer insulating film 58 with a specified film thickness can be certainly left.

Further, since the polishing is performed while the wafer holder 50 and the polisher 41 are turned with an equal angular speed in the same direction, the wafer holder 50 is similar in the relative speed to the polisher 53 over the whole surface of the wafer 53, which enables the uniform polishing irrespective of the location to be polished.

This makes it possible to eliminate the observation for the wafer through polishing, and hence to simplify the processes, and further to improve the uniformity in polishing.

Additionally, in the above second embodiment, the turning speeds of the wafer holder 50 and the polisher 41 are made constant through polishing; however, the turning speeds thereof may be adjusted as follows: namely, in the case that the detected current is larger, the turning speed of the wafer holder 50 or the polisher 41 is made slow, and in the case that the detected current is small, it is made high. Thus, by adjustment of the turning speed, it is possible to control the polished volume with the same radius distance, and hence to further equalize the polished volume within the surface of the wafer 53. The reason for this is that, the higher the turning speed becomes, the larger the polishing speed becomes; and the lower the turning speed becomes, the smaller the polishing speed becomes.

(B) Comparative evaluation experiment for the method for polishing according to the second embodiment of the present invention To quantitatively evaluate the method for polishing of the present invention, the following comparative evaluation experiment was performed.

1. Preparation of sample

Figure 15:
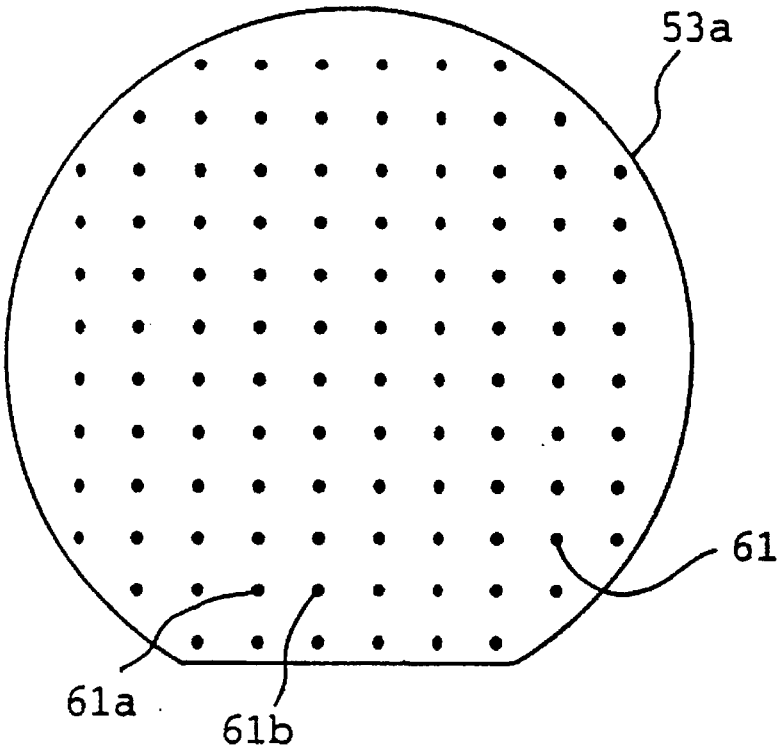
FIG. 15(*a*) and FIG. 15(*b*) are explanatory views for a sample used in examination for confirming the effect of the method for polishing according to the second embodiment of the present invention, wherein FIG. 15(*a*) is a plan view of the whole wafer.
Figure 15:
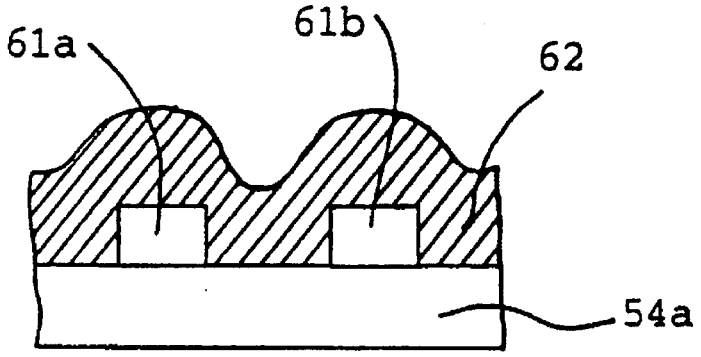

As shown in FIG. 15(*a*) and FIG. 15 (*b*), cylindrical studs (conductive layers) 61, 61*a* and 61*b*, each being formed of an aluminum material with a diameter of 2 μm and a height of 0.5 μm, were formed on a wafer 53*a* with a diameter of 150 mm at intervals of 10 mm in a dotted manner. The studs (conductive layers) 61, 61*a* and 61*b* were formed in such a manner as to be directly contacted with a semiconductor substrate 54*a*. After that, a silicon oxide film (insulating film) 62 was formed in a thickness of 1 μm by a CVD method.

2. Polishing experiment

Figure 16:
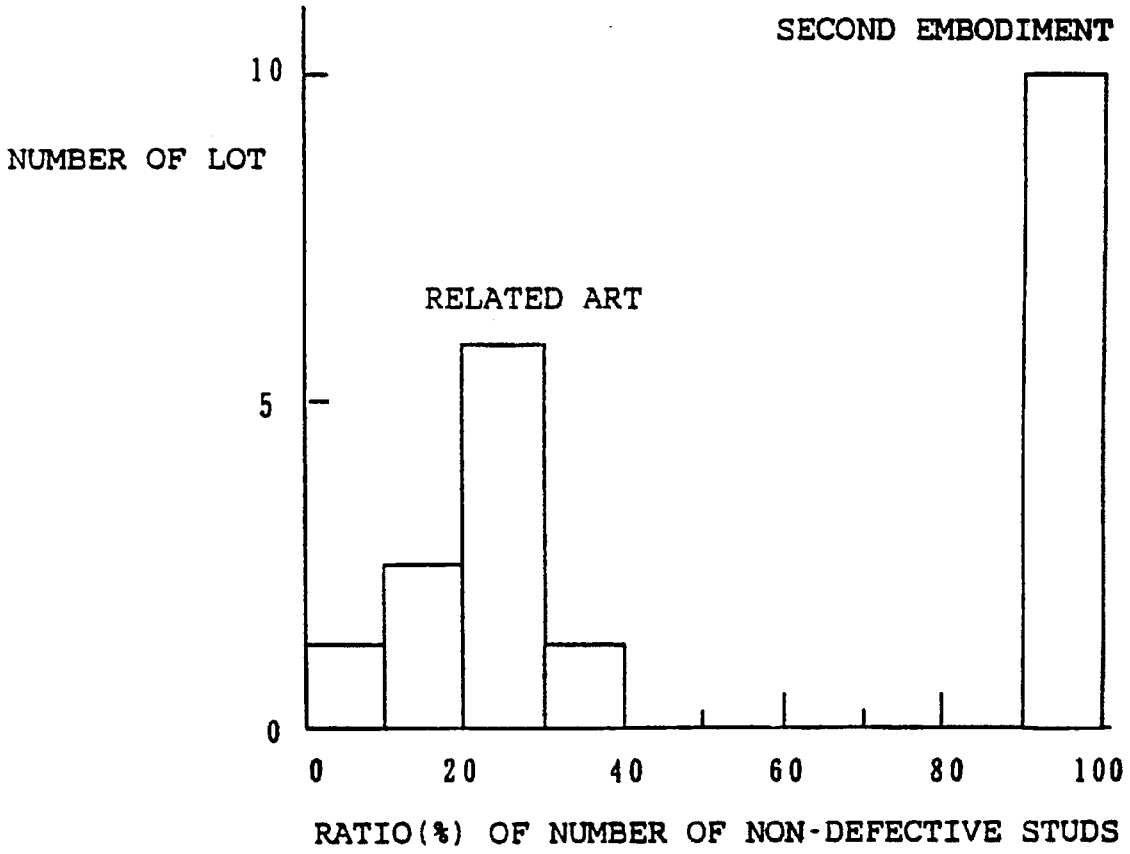
FIG. 16 is an explanatory view for the examination result of confirming the effect of a method for polishing according to a third embodiment of the present invention.

The above samples were polished by the method for polishing of the related art and the method for polishing of the present invention. In this case, the detected current is allowed to flow by way of the one electrode 45*b*, the studs 61*b*, the semiconductor substrate 54*a*, the studs 61*a* and the other electrode 45*a*. The evaluation is as follows:

After the silicon oxide film 62 on the studs 61 in the peripheral portion with a diameter less than 15 mm was all removed, the number of the studs 61 not removed or the studs 61 with a remaining height of 0.2 μm or more was counted. The results of the examination for 10 lots are shown in FIG. 16.

As is apparent from the examination results described above, as for the remaining silicon oxide film 62, the unevenness of the film thickness within the wafer 53*a* and the average film thickness between the wafers are significantly improved as compared with the related art.

(3) A method for polishing according to a third embodiment of the present invention The method for polishing according to the third embodiment of the present invention using the apparatus for polishing of the second embodiment of the present invention will be described with reference to FIG. 12(*a*), FIG. 12(*b*), and FIG. 13(*a*) and FIG. 13(*b*).

First, a wafer 53 as shown in FIG. 13(*a*) is held and fixed by vacuum chuck on the wafer holder 50.

The wafer holder 50 is opposed to a polisher 41*a* in such a manner that an interlayer insulating film 58 on the wafer 53 is in parallel to a polishing cloth 43*a*. After that, as shown in FIG. 12(*b*), the wafer holder 50 is turned, and concurrently the wafer holder 50 is moved upward or the polisher 41*a* is moved downward so that the wafer is contacted with the polishing cloth 43*a*. At the same time, a polishing slurry 60 containing ions are discharged on the wafer 53 through a through-hole of the polisher 41*a*. In addition, as shown in FIG. 12(*a*), the polisher 41*a* is disposed such that the larger area portion of the asymmetric polishing cloth 43*a* is near the central portion of the wafer holder 50 and the smaller area portion of the polishing cloth 43*a* is apart from the central portion of the polishing cloth 43*a*.

Subsequently, as shown in FIG. 13(*b*), the polisher 41*a* is pressed on the surface of the wafer 53, to polish the interlayer insulating film 58 on the wafer 53. At this time, an ammeter 48 is monitored. When the polishing proceeds somewhat, and conductive layers 57*a* and 57*b* are exposed, a current is allowed to flow by way of the one electrode 45*b*, the conductive layer 57*b*, a lower interconnection layer 56, the conductive layer 57*b* and the other electrode 45*a*, which is detected by the ammeter 48. Thus, the polishing of the interlayer insulating film 58 is completed.

Next, the polisher 41*a* is moved to an region adjacent to the region in which the polishing is completed in the direction perpendicular to the direction of rotating the wafer holder 50. Subsequently, the interlayer insulating film 58 is similarly polished. Thus, the polishing is sequentially performed, to complete the polishing over the whole surface of the wafer 53.

As shown in FIG. 14, the interlayer insulating film 58 with a specified amount is uniformly polished over the whole surface of the wafer 53, to planarize the surface of the wafer 53, thus exposing the conductive layers 57*a* to 57*d* over the whole surface of the wafer 53.

After that, as shown in FIG. 13(*c*), upper interconnection layers 59*a* and 59*b* are formed so as to be respectively connected to the exposed conductive layers 57*a* and 57*b*, and thereby the upper interconnection layers 59*a* and 59*b* are connected to the lower interconnection layer 56 through the conductive layers 57*a* and 57*b*, respectively.

As described above, according to the third embodiment of the present invention, the turnable wafer holder 50 and the asymmetric polishing cloth 43*a* are provided, and the polisher 41*a* is disposed in such a manner that the larger area portion of the polishing cloth 43*a* is disposed near the central portion of wafer holder 50 and the smaller area portion is disposed apart from the central portion of the wafer holder 50.

Accordingly, as described in the second example of the second embodiment, the polished volume of a substance to be polished during the polishing cloth 43*a* is moved along the circumference of the wafer becomes constant both on the inner side and outer side of the polishing cloth 43*a*, so that it is possible to reduce the unevenness of the polished volume within the wafer 53. Consequently, in combination with the current detecting means 46, it is possible to uniformly polish the substance to be polished on the wafer 53.

Further, only by moving the polisher 41*a* in the direction perpendicular to the turning direction of the wafer holder 50 on the wafer 53, it is possible to uniformly polish the whole surface of the wafer 53. Additionally, in the above third embodiment, the pressure to the polisher 41*a* is made constant through polishing; however, in the case that the detected current is larger, the pressure to the polisher may be reduced, and in the case that the detected current is smaller, it may be enlarged. Thus, by adjustment of a pressure, it is possible to control the polished volume with the same radius distance, and to further equalize the polished volume within the surface of the wafer. This is because, the larger the pressure becomes, the larger the polishing speed becomes; and the smaller the pressure becomes, the smaller the polishing speed becomes.

What is claimed is:

1. An apparatus for polishing comprising:

a polisher having a polishing cloth, a plurality of through-holes for passing a polishing slurry containing ions, and a pair of electrodes formed in at least two pieces of a plurality of said through-holes in such a manner as to be electrically separated from each other;

a wafer holder having a wafer holding surface with conductivity, on which holding a substrate having conductive layers covered with an insulating film;

a current detecting means connected to a pair of said electrodes for detecting the magnitude of a current flowing by way of said one electrode, said conductive layers, and the other electrode by the interposition of said abrasive.

2. An apparatus for polishing according to claim 1, wherein at least any of said polisher and said wafer holder turns on a shaft perpendicular to said wafer holding surface.

3. A method for polishing comprising the steps of:

holding on a wafer holding surface of a wafer holder a substrate having conductive layers covered with an insulating film;

turning on a shaft perpendicular to said wafer holding surface at least any of said wafer holder and a polisher having a polishing cloth, a plurality of through-holes for passing a polishing slurry containing ions and a pair of electrodes in at least two pieces of a plurality of said through-holes in such a manner as to be electrically separated from each other;

bringing said insulating film in contact with said polishing cloth, and polishing said insulating film while supplying said abrasive; and monitoring a current flowing between a pair of said electrodes through said conductive layers by the interposition of said abrasive, and in the case that a specified current has been detected, polishing said insulating film on the other portion of said substrate.

4. A method for polishing according to claim 3, wherein said polishing cloth is asymmetrically formed, and on said substrate, a large area portion of said polishing cloth is disposed near said shaft and a smaller area portion of said polishing cloth is disposed apart from said shaft.

5. A method for polishing according to claim 3, wherein the turning speed of said wafer holder or said polisher is increased when said current value is small, and the turning speed of said wafer holder or said polisher is decreased when said current value is large.

6. A method for polishing according to claim 3, wherein said wafer holder and said polisher are turned with the same angular speed in the same direction.

7. A method for polishing according to claim 3, wherein said polisher is moved on said substrate in the direction perpendicular to the turning direction of said wafer holder.

8. A method for polishing according to claim 7, wherein the pressure applied to said substrate is increased when said current value is small; the pressure applied to said wafer is decreased when the current value is large; and when a specified current has been detected, the insulating film on the other portion on said wafer is polished.

* * * * *